United States Patent [19]

Buchl

[11] Patent Number: 4,715,330

[45] Date of Patent: Dec. 29, 1987

[54] ELECTROMAGNETICALLY-ACTUATED POSITIONING MECHANISM

[76] Inventor: Josef Buchl, Rehsteig 12, 8071 Lenting, Fed. Rep. of Germany

[21] Appl. No.: 850,935

[22] Filed: Apr. 11, 1986

[30] Foreign Application Priority Data

Apr. 12, 1985 [DE] Fed. Rep. of Germany ..... 3513109

[51] Int. Cl.[4] ..... F01L 9/04; H01F 7/08

[52] U.S. Cl. ..... 123/90.11; 251/129.1; 251/129.16; 251/129.18; 335/266

[58] Field of Search ..... 123/90.11; 251/129.09, 251/129.1, 129.16, 129.18; 335/256, 258, 262, 266, 268

[56] References Cited

U.S. PATENT DOCUMENTS 4,455,543 6/1984 Pischinger et al. ..... 335/266

*Primary Examiner*—Tony M. Argenbright

*Attorney, Agent, or Firm*—Jacques M. Dulin

[57] ABSTRACT

An electromagnetically-actuated positioning mechanism for opposed spring-biased reciprocating valve actuators in displacement machines, having an electromagnetically-actuated adjusting solenoid device for shifting the locus of equilibrium of the actuators' spring systems at startup. While the position of equilibrium is predetermined when the adjusting solenoid is in the energized state, it is unnecessary for valves to be in the fully closed position when the adjusting solenoid is in the non-energized state. In the position of equilibrium as shifted by adjusting device, the distance of a gas exchange valve from one of the two operating positions is approximately 10% to 40% of the total distance between the two operating positions, and is at least partly open. The invention is particularly applicable to lifting valves and sliding gate valves, and for valves in internal combustion engines.

5 Claims, 1 Drawing Figure

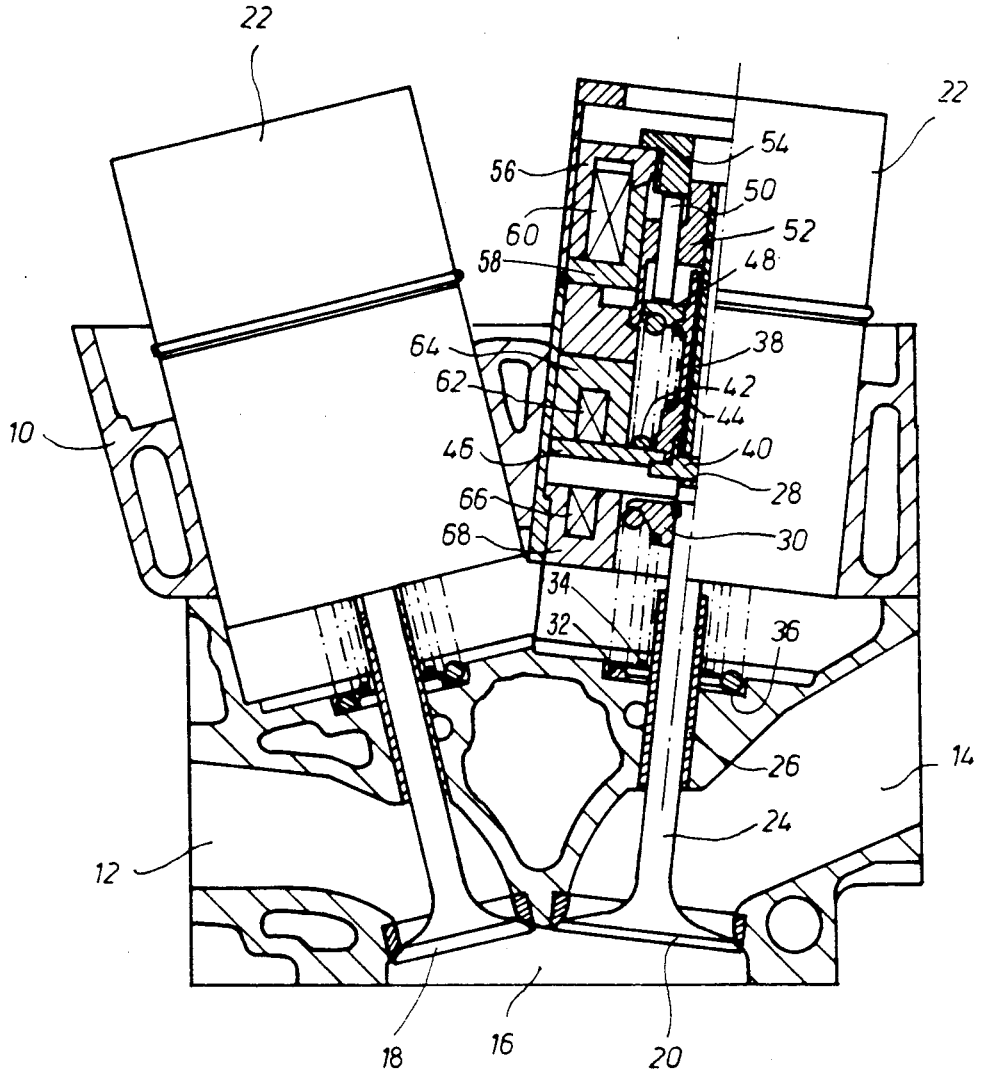
22
22
54
56
50
60
52
58
48
64
38
62
42
44
10
46
40
28
66
68
30
34
32
36
26
14
24
12
18
16
20

ELECTROMAGNETICALLY-ACTUATED POSITIONING MECHANISM

FIELD

The invention concerns an electromagnetically-actuated positioning mechanism for reciprocating actuators (particularly for lifting valves and sliding gate valves) in displacement machines having a spring system and two electrically-operated actuating solenoids by means of which the actuator may be moved between two discrete, mutually-opposite operating positions, whereby the locus of equilibrium of the spring system is situated between the two operating positions, and having an adjusting device which shifts the position of equilibrium of the spring system, characterized by the fact that said locus of equilibrium differs from the operating positions when shifted by the adjusting device. The mechanism of the invention is particularly useful for gas exchange valves in internal combustion engines.

BACKGROUND

A similar positioning mechanism is known from DE-OS No. 30 24 109 corresponding to U.S. Pat. No. 4,455,543 therein described concerns a control component in a displacement machine (e.g., a gas exchange valve in an internal combustion engine) which is maintained in each of its opened and closed positions by magnetic attraction, whereby the magnets act against a spring sytem. Two solenoids, situated opposite from one another, hold the gas exchange valve in a given operating position; when the solenoids are not excited (energized), the gas exchange valve's anchor plate, upon which the solenoids exert their attractive force, is situated midway between the solenoids.

Upon startup, however, the attractive force of the solenoids, acting against the spring loading, is insufficient to bring the valve to one of the two operating positions with absolute reliability.

DE-OS No. 30 24 109 therefore recommends the provision of an adjusting unit (also in the form of a solenoid in the embodiment shown therein) in addition to the two actuating solenoids which define the two operating positions. When this adjusting solenoid is not energized, the actuator's anchor plate is not situated midway between the two solenoids, but is instead in contact with the solenoid which defines the closed position. Upon being energized, the adjusting solenoid attracts a support which defines the seat of the spring system, whereby the spring system seat and thus the position of equilibrium of the spring system are simultaneously shifted. This new position of equilibrium, caused by adjusting solenoid energization, is selected such that the actuator's anchor plate is situated between the two actuating solenoids.

Upon startup of the mechanism described in DE-OS No. 30 24 109, energizing one of the actuating solenoids, with which the anchor plate is in contact, is followed by energizing the adjusting solenoid, in order to shift the spring system seat which defines the position of equilibrium of the spring system, such that, upon actuating-solenoid energization, the position of the anchor plate is shifted from contact with one actuating solenoid to a central position between the two actuating solenoids.

As the spring system is of relatively stiff construction in order to achieve rapid actuating times, a relatively strong force is required for action against the spring system, leading to large adjusting-solenoid dimensions.

As the space available is limited, particularly for closely spaced valves in multi-cylinder internal combustion engines, there is thus a need in the art for a smaller adjusting solenoid mechanism.

THE INVENTION

Objects

It is among the objects of the invention to provide an adjusting solenoid mechanism allowing for smaller physical dimensioning.

It is another object of the invention to provide an electromagnetically-actuated positioning mechanism for reciprocating actuators (particularly for lifting valves and sliding gate valves( in displacement machines, having a spring system and two electrically-operated actuating solenoids by means of which the actuator may be moved between two discrete, mutually-opposite operating positions, whereby the locus of equilibrium of the spring system is situated between the two operating positions, and having an adjusting device which shifts the position of equilibrium of the spring system.

It is another object of the invention to provide an adjusting device for an electromagnetically-actuated positioning mechanism for opposed spring-biased reciprocating actuators which shifts the locus of equilibrium of the actuators' spring system to a position different from the operating positions.

It is another object of the invention to provide an improved electromagnetically-actuated adjusting device for gas exchange valves in internal combustion engines, characterized by the fact that, in the position of equilibrium shifted by the adjusting device, the gas exchange valve is at least partially open.

It is another object of the invention to provide an improved electromagnetically-actuated adjusting device for shifting the equilibrium position of spring-biased gas exchange valves in internal combustion engines characterized by the fact that, in the position of equilibrium as shifted by the adjusting device, the distance of the gas exchange valve from one of the two operating positions is approximately 10% to 40% of the total distance between the two operating positions.

Still other objects will be evident from the following specification, claims and the drawing.

THE DRAWING

The FIGURE is a side view, partially in section, showing the spring-biased actuating solenoids and the electromagnetically-actuated adjusting device of this invention which shifts the equilibrium point of the spring system of the actuating solenoids.

SUMMARY

The invention provides an electromagnetically-actuated positioning mechanism for spring-biased valve actuators in displacement machines, such as for lifting valves and sliding gate valves, wherein the actuator spring equilibrium may be shifted at startup by an adjusting solenoid device. While the position of actuator spring equilibrium is predeteremined when the adjusting solenoid is in the energized state, it has been established pursuant to the invention that it is unnecessary for valves to be in the fully closed position when the adjusting solenoid is in the non-energized state. As a consequence, a significant reduction of adjusting solenoid dimensions may be achieved.

The invention is particularly applicable to internal combustion engines having electromagnetically-actuated positioning mechanism for reciprocating actuators of the type which have a spring system (typically comprising at least 1 pair of opposed springs having an equilibrium locus therebetween), and two electrically-operated actuating solenoids by means of which the actuator may be moved between two discrete, mutually-opposite operating positions, whereby the locus of equilibrium of the spring system is situated between the two operating positions. The adjusting solenoid device of this invention is disposed to shift the position of equilibrium of the spring system so that the locus of the spring system equilibrium differs from the operating positions when shifted by the adjusting device.

Pursuant to the invention, the position of equilibrium does not correspond to one of the two operating positions when in the non-energized state, i.e., the actuator is not in its "closed" position when in the position of equilibrium in the non-energized state.

As a result, the shifting distance to be travelled by means of the adjusting solenoid is shorter than it would be if the adjusting solenoid had to move from the closed position to the central position. As the adjusting solenoid does not have to shift over such large travel distances, its dimensions may be correspondingly reduced.

Upon startup of the device pursuant to the invention, the actuating solenoid is first energized and moves the actuator to one of its operating positions (preferably the closed position). The actuator is thus is a defined position, and subsequent energizing of the adjusting solenoid shifts the locus of equilibrium of the spring system from an eccentric position between the actuating solenoids to a central position between the actuating solenoids, such that the subsequent movement of the actuator will be symmetrical between the two solenoids.

Pursuant to the invention, it has been ascertained that, in contrast to the opinion expressed in DE-OS No. 30 24 109, no negative effects are observed in internal combustion engines even if the cylinders' gas exchange valves remain open for a relatively long period of time.

In the preferred embodiment the gas exchange valve remains at least partly open in the rest state, i.e., the adjusting device shifts the locus of equilibrium of the actuator spring sytem. The film of lubricant present in the interior of an internal combustion engine cylinder will prevent damage if the engine stands with open gas exchange valves over a prolonged period of time.

When the adjusting solenoid is not energized, the locus of the position of equilibrium of a gas exchange valve as shifted by the adjusting device is such that the distance of the gas exchange valve form one of the two operating positions is approximately 10% to 40% of the total distance between the two positions.

DETAILED DESCRIPTION OF THE BEST MODE OF THE INVENTION

In the following detailed description, the invention will be described with reference to the figure. This description is by way of example and not by way of limitation of the principles of the invention.

The single FIGURE illustrates a partial cross-section of the engine block of an internal combustion engine. Item 10 indicates the cylinder head. An intake port 12, which may be selectively closed with an intake valve 18, leads into cylinder bore 16. An exhaust port 14, which may be selectively closed with an exhaust valve 20, leads out of cylinder bore 16. Valves 18 and 20 are actuated by an electromagnetic positioning system situated in housing 22. The unit situated in housing 22 is preferably identical for both intake and exhaust valves, in order to reduce the range of parts required. Nonetheless, it is possible to match intake and exhaust valve characteristics to specific design requirements. It may thus be observed in the Figure that the disk of exhaust valve 20 is larger than the disk of intake valve 18.

As there is no theoretical difference between intake and exhaust valve construction, the following discussion will refer to the exhaust valve only.

Valve disk 20 is integral with valve stem 24 which slides in valve guide 26, inserted in cylinder head 10. The end of valve stem 24, indicated as Item 28, has a bearing surface which contacts a tappet 40, to be described below.

A flange 30 is circumferentially mounted on the end of valve stem 24 opposite valve disk 20. Flange 30 acts as a seat for a spring system consisting of a large spiral spring 32 and a small spiral spring 34. Both spiral springs 32 and 34 are coaxially installed. The opposite spring seat 36 is formed by a bearing surface in the cylinder head. Valve stem 24 may be actuated in valve guide 26 against the loading of springs 32 and 34, causing valve disk 20 to rise off its seat and open exhaust port 14.

An axial extension to valve stem 24 is formed by actuator rod 38, the lower end of which is fitted with tappet 40, which makes contact with valve stem 26. An annular anchor plate 46, made of ferromagnetic material, is fastened to actuator rod 38 in the region of tappet 40. This anchor plate also supports a spring sytem consisting of a large spiral spring 42 and small spiral spring 44, which are also coaxial to one another and to rod 38. The actuator assembly comprises rod 38, tappet 40 and plate 46.

The seat for this loading system 42 and 44 is formed by a support 48, to be described in greater detail.

A magnet core 68 having a U-shaped cross-section is annularly installed, the axis of the annulus coinciding with the axis of valve stem 24. A coil 66 is situated inside magnet core 68. The open side of U-sectioned magnet core 68 faces in the direction of the anchor plate.

Actuator rod 38 is likewise surrounded by a similarly-shaped magnet core 64, inside of which is a coil 62. Depending on excitation of solenoids 62 and 66, anchor plate 46 moves from a contact face on magnet core 64 to a contact face on magnet core 68, and back again.

Also provided is an adjusting solenoid consisting of a magnet core 58 and a coil 60. Excitating of coil 60 attracts ferromagnetic componet 56, which is joined to part 54. This movement, caused by excitation of adjusting solenoid coil 60 and acting on part 54, is transmitted by means of pin 50, placed in a cover plate 52, to the spring-system seat formed by support 48, whereby energizing adjusting solenoid coil 60 shifts the seat of springs 42 and 44.

Operation of the positioning system of the invention is as follows:

It is assumed that the entire system is deenergized and is in the rest state. Coils 62 and 66 are deenergized, as is coil 60. Component 54 is thus positioned such that no force is being exerted on pin 50, and springs 42 and 44 are fully relaxed. Opposing springs 34 and 32 may thus also relax, and spring length is designed such that anchor plate 46 is not centrally situated between solenoid cores 64 and 68. The distance separating anchor plate 46 and core 64 is smaller than the distance between anchor plate 46 and core 68. If total travel by anchor plate 46 between core 64 and core 68 is approximately 7 mm, the distance between core 64 and anchor plate 46 is approx. 2 mm in the relaxed state.

As the closed position of gas exchange valve 20 is essentially defined only when anchor plate 46 has been attracted by solenoid core 64 (whereby a certain amount of overtravel is disregarded), gas exchange valve 20 is slightly open in the abovementioned relaxed state.

Upon engine startup, coil 62 and coil 60 are energized in sequence. As coil 62 is designed for more rapid operating times than coil 60, both coils may also be simultaneously energized. Current flow through coil 62 causes an attractive force to be exerted on anchor plate 46. As the anchor plate is separated from solenoid core 64 by about 2 mm, the anchor plate will be immediately displaced against the opposing force of springs 42 and 44. As the overall system is relaxed, the force exerted on anchor plate 46 by springs 42 and 44 in opposition to the attractive force of solenoid 64 is relatively weak.

Adjusting solenoid core 58 is energized by current flow through coil 60 and attracts adjusting device 56, which transfers this movement, in the direction of valve 20 opening, through part 54 and pin 50 to seat 48 of the spring system. The position of equilibrium of the spring system thus also shifts in the direction of valve 20 opening, whereby the distance is selected such that the position of equilibrium of the spring sytem now lies midway along the path travelled by anchor plate 46 between the contact face of solenoid core 64 and the contact face of solenoid core 68.

If coil 66 is now energized and coil 62 subseqeuently energized, anchor plate 46 is released from solenoid core 64. The anchor plate will be strongly accelerated by springs 42 and 44, which have in the meantime undergone loading. Tappet 40 pushes valve stem 24 downward and the valve opens until anchor plate 46 comes into contact with solenoid core 68, where it is held by means of current flow through coil 66. Springs 42 and 44 are thus relaxed, while springs 32 and 34 are loaded.

The subsequent actuating event results in a reversal of this movement.

In order to eliminate any difference between opening and closing movement and to achieve identical solenoid design, the position of equilibrium of the spring system is henceforth defined as lying between cores 64 and 68, i.e., if both coils 62 and 66 were to be deenergized, anchor plate 46 would position itself midway between cores 64 and 68. The preloading required for this is provided by adjusting solenoid 60 and its core 58.

As mentioned above, adjusting solenoid core 58 is capable of exerting a relatively strong force against springs 42 and 44; as it is required to generate static force only during the operating sequence, and as it is not subject to dynamic events, it does not require a very high current input.

The size of the solenoid is relatively large, due to its large number of coil turns. Pursuant to the invention, however, it is possible to limit the force required of this solenoid, such that its physical dimensions can be reduced.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. Electromagnetically-actuated positioning mechanism for valve-type reciprocating actuators in displacement machines comprising in operative combination:

(a) means for reciprocatingly actuating a valve member, said reciprocating actuator means being movable between two discrete, mutually-opposite operating positions;

(b) said reciprocating actuator means having an electromagnetically attractable member and being disposed to move said valve member from a first, closed operating position to a second, open operating position;

(c) said valve member being biased to said first closed position by at least one spring member;

(d) said reciprocating actuator means being biased toward said second open position by at least one spring member;

(e) a pair of electromagnetics disposed to selectively attract said electromagnetically attractable member to said first or said second operating position when energized;

(f) said spring members forming a spring system having a locus of equilibrium situated between said two operating positions;

(g) means for adjusting the locus of equilibrium of said spring system to shift said locus to a position different from either of said operating positions;

(h) said adjusting means comprises an electromagnetically-actuated member disposed to exert compressive force on at least one of said actuator spring members when energized to shift said spring system equilibrium locus as compared to the locus when said adjusting means electromagentically-actuated member is de-energized; and (i) said valve member is at least partly open when said adjusting means is in its de-energized state.

2. Electromagnetically-actuated positioning mechanism as in claim 1 wherein:

(a) said valve is disposed from one of the two operating positions a distance in the range of about 10% to 40% of the total distance between the two operating positions when said adjusting means is in its de-energized state.

3. Electromagnetically-actuated positioning mechanism as in claim 2 wherein:

(a) said mechanism is disposed in association with at least one gas exchange valve in an internal combustion engine.

4. Electromagnetically-actuated positioning mechanism as in claim 2 wherein:

(a) said spring system locus is substantially at the mid-point between the two operating positions when said adjusting means is in the energized state.

5. Electromagnetically-actuated positioning mechanism as in claim 4 wherein:

(a) said mechanism is disposed in association with at least one gas exchange valve in an internal combusion engine.

* * * * *